US005918884A

United States Patent [19]

DiMuro

[11] Patent Number: 5,918,884

[45] Date of Patent: Jul. 6, 1999

[54] METHOD OF PLAYING A CASINO CARD GAME

[76] Inventor: Joseph T. DiMuro, 5460 E. Arthur St., Inverness, Fla. 34452

[21] Appl. No.: 08/995,312

[22] Filed: Dec. 22, 1997

[51] Int. Cl.[6] ..... A63F 1/00

[52] U.S. Cl. ..... 273/292; 273/309; 273/274

[58] Field of Search ..... 273/292, 274, 273/309

[56] References Cited

FOREIGN PATENT DOCUMENTS

| | | | |
|---|---|---|---|
| 526357 | 10/1920 | France | 273/274 |
| 1448999 | 7/1966 | France | 273/274 |

*Primary Examiner*—Benjamin H. Layno
*Attorney, Agent, or Firm*—Ronald E. Smith, P.A.

[57] ABSTRACT

A card game that may be played at home or in a casino includes a game board having a plurality of card positions imprinted upon it. The actual card positions may vary, but in a preferred embodiment there are two positions representing Joker cards, thirteen positions representing cards of value Ace through King of any suit, four positions representing the four suites of cards of any value, one position representing a predefined "high" card of any suit, one position representing a predefined "low" card of any suit, and fifty two cards representing all of the cards of a deck of cards. The players cover as many positions as they wish with markers, and a card is selected at random from a shuffled deck of cards. All markers that cover positions that match the randomly selected card are winning markers, and all markers that do not are losing chips. The odds for the Joker position may differ from the odds for the Ace through King positions, and so on.

3 Claims, 2 Drawing Sheets

METHOD OF PLAYING A CASINO CARD GAME

BACKGROUND OF THE INVENTION

1. Field of the Invention

This invention relates, generally, to a method for playing a card game that includes a game board. More particularly, it relates to a game that challenges players to predict what card will be randomly drawn from a deck of cards.

2. Description of the Prior Art

A good description of the prior art in the field of this invention is found in U.S. Pat. No. 5,431,407 to Hofberg and others. That description discusses the drawbacks of games such as slots (slot machines), poker, blackjack, and craps. Some of the games, such as slots, are too easy to play, and some of them, such as craps, are too difficult for new gamblers.

The Hofberg patent discloses a casino card game where an opening card is randomly selected from a set of cards. The position of the opening card in an ordered sequence (Ace to King) is taken as the starting position in the game play sequence. For example, if the opening card is a Jack, the game play sequence is Jack to ten (Jack, Queen, King, Ace, two, etc.). Cards are then drawn from a shuffled deck, one at a time, to see if the drawn card matches the next card in the sequence. The house wins if it does, the players win if none of the drawn cards matches the predetermined sequence. For example, the house wins in the example given if the first card drawn is a Queen, or if the second card drawn is a King, and so on. Side bets may be made as to whether the next card drawn will be a high card or a low card, a Joker, and so on.

One drawback of the Hofberg method is that the players will get the feeling that they must run a gauntlet, so to speak, because they win only if the house loses twelve consecutive times. Any match at all by the house, even on the last card drawn, defeats the players. The side bets increase the chances for the players to at least win something during the game, but most players, especially newcomers to the gaming industry, do not fully understand the concept of a side bet and consider such bets to be a distraction from the main game.

What is needed, then, is a card game where the players need not suffer through multiple card draws made by the house to see if the house eventually wins. Instead, the needed game would enable players to win or lose, or both, after each draw of a card from a shuffled set of cards.

There is also a need for a card game that teaches players about how odds work and the interplay between under-exposure to winning and over-exposure to losing.

Moreover, there is a need for a card game that may be played in a casino against the house or in a home among friends with no "house" involved.

However, in view of the art considered as a whole at the time the present invention was made, it was not obvious to those of ordinary skill in this art how the needed game could be provided.

SUMMARY OF THE INVENTION

The longstanding but heretofore unfulfilled need for an apparatus that overcomes the limitations of the prior art is now met by a new, useful, and nonobvious invention. The present invention includes a method of playing a card game that includes the steps of providing a first plurality of indicia means representing all of the face values of cards in a deck of cards without specifying any suit, providing a second plurality of indicia means representing the four suits in a deck of cards without specifying any face value, providing a third plurality of indicia means representing all individual cards in a deck of cards wherein each indicia means specifies a card by its face value and its suit, providing a fourth indicia means representing all of the face values of cards in a deck of cards that are equal to or below a preselected face value, providing a fifth indicia means representing all of the face values of cards in a deck of cards that are above said preselected value, and providing a sixth indicia means representing at least one Joker card.

To play the game, at least one player positions at least one marker on at least one indicia means of the first, second, third, fourth, fifth, or sixth plurality of indicia means. A deck of cards is randomly shuffled and a single card is randomly selected from the shuffled deck of cards. The at least one player wins a predetermined monetary or nonmonetary prize only if said at least one marker is positioned on an indicia means matching the randomly selected single card. However, the markers that may have been placed on an indicia means that does not match the randomly selected card are lost by the at least one player.

In other words, at least one marker positioned on at least one of the indicia means of the first, second, third, fourth, fifth, or sixth indicia means results in a win by the at least one player positioning said marker thereon if the marker is positioned on an indicia means that matches the randomly selected single card.

It is a primary object of this invention to provide an exciting casino card game having rules that are easy to understand.

Another object is to provide a game that has educational value, related to the subjects of odds and over or under exposure to risks.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
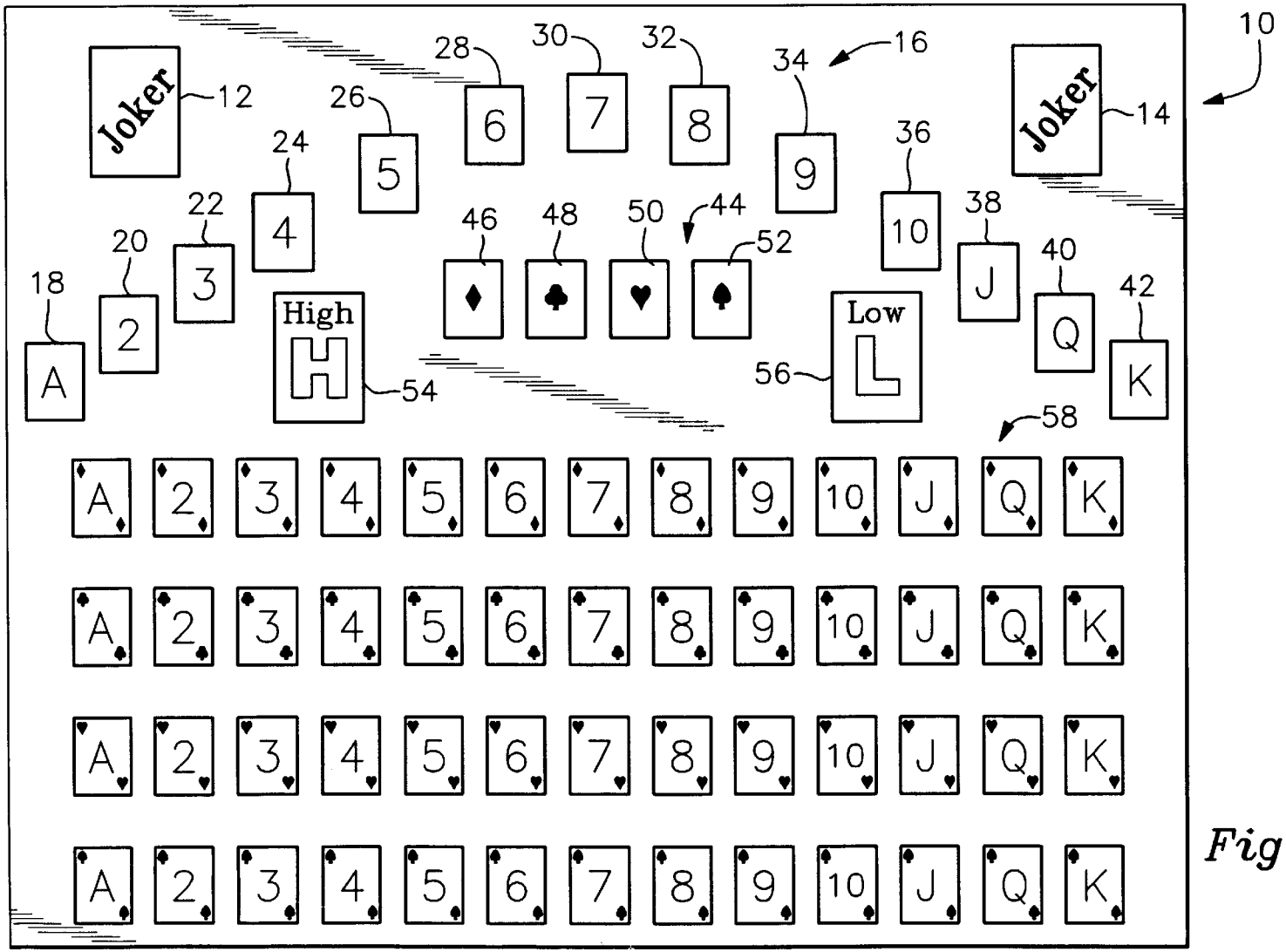
FIG. 1 is a top plan view of the novel game board.

Referring now to FIG. 1, it will there be seen that an exemplary embodiment of the invention is denoted as a whole by the reference numeral 10.

Game board 10 includes a first Joker card position 12 in its upper left hand corner and a second Joker card position 14 in its upper right hand corner. Of course, a Joker card has no value on the scale of Ace to King, nor is it specific as to suit.

A set of card positions that is specific as to value but non-specific as to suit is positioned across the top of the game board in an arcuate array as denoted by the reference numeral 16 as a whole. Specifically, array 16 includes, from left-to-right, positions for an Ace card 18, a 2 card 20, a 3 card 22, a 4 card 24, a 5 card 26, a 6 card 28, a 7 card 30, an 8 card 32, a 9 card 34, a 10 card 36, a Jack card 38, a Queen card 40, and a King card 42, it being understood that all of said positions represent cards of any suit.

An array of suit-specific but value non-specific card positions is denoted as a whole by the reference numeral 44. Array 44 includes a position 46 for any diamond suit card, a position 48 for any club suit card, position 50 for any heart suit card, and position 52 for any spade suit card.

A card position having the letter "H" written thereon is denoted 54 and a card position having the letter "L" written thereon is denoted 56. These positions are nonsuit specific but are value or number specific, i.e., any card of value 8 or higher, up to King, is a high card and any card of value 7 or lower, down to 2, is a low card. An Ace is defined as neither high nor low in this situation.

The remaining card positions, denoted 58 as a whole, represent each card in a standard fifty two card deck of poker cards.

Figure 2:
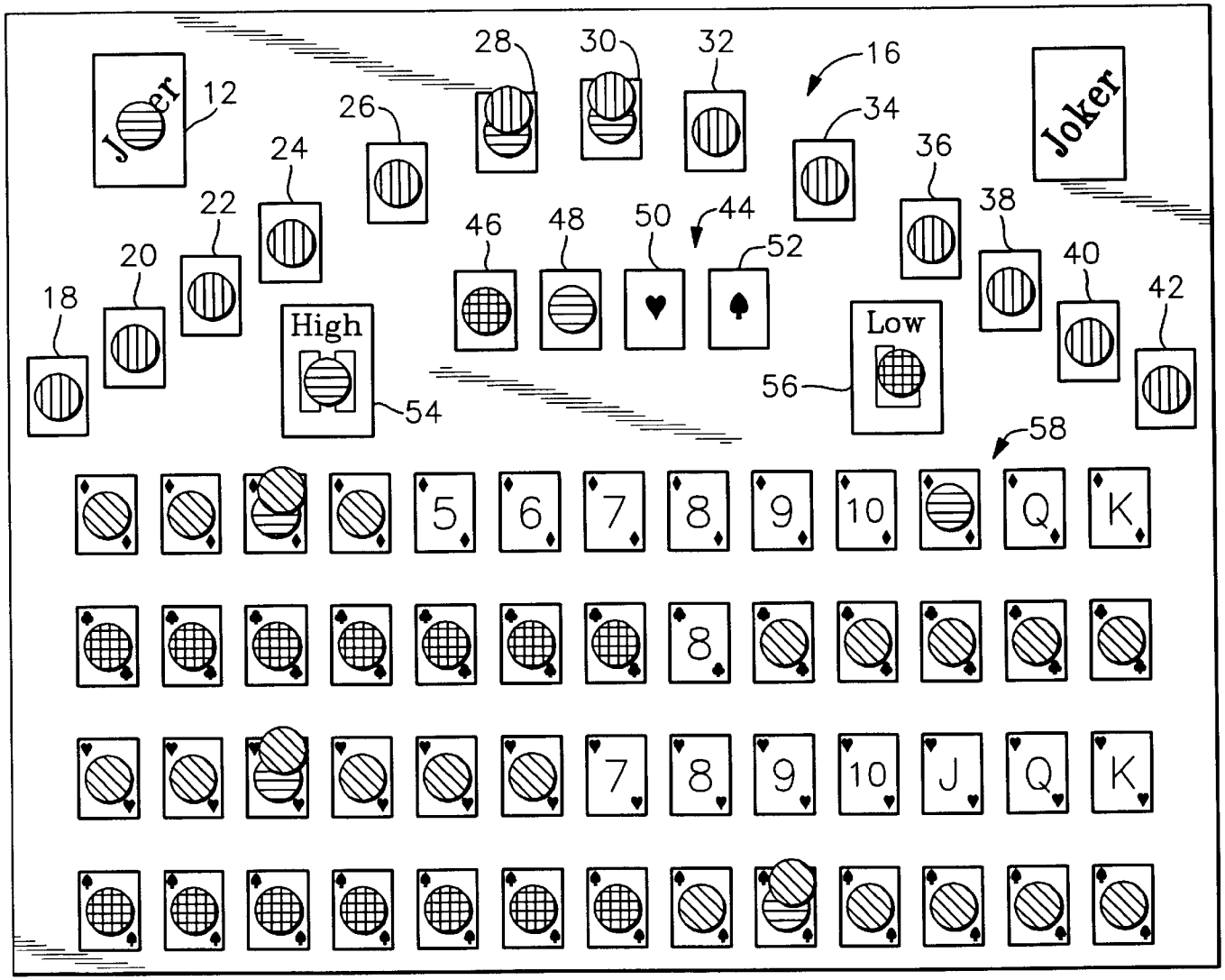
FIG. 2 is a top plan view of the novel game board during play.

The novel method is best explained in connection with FIG. 2 which depicts the novel game board after four players have made bets. Player 1, playing with blue chips, has covered Joker position 12, nonsuit-specific positions 28, 30 (numbered 6 and 7), club position 48, "High" position 54, the Jack of diamonds, the 3 of hearts, and the 9 of spades. Player 2, playing with red chips, has covered all of the positions in array 16; note that the red chips of player two are stacked atop the blue chips of player one at positions 28, 30. Player 3, playing with yellow chips, has covered position 46, "L" position 56, Ace-through 7 of clubs, and Ace through 7 of spades. The fourth player, having green chips, has covered Ace-through 4 of diamonds, 9 through King of clubs, Ace through 6 of hearts, and eight through King of spades.

A deck of cards containing a Joker is shuffled by the house, and one of the players is invited to cut the deck by inserting a plastic card thereinto at any desired location. The house displays the card in the shuffled deck that is just above the inserted plastic card, and that card is the winning card. Suppose that the winning card is the nine of clubs. Player number two, playing the red chips, has covered position 34 and thus wins a monetary return at preselected odds. Player number one, having covered position 48, also wins at predetermined odds. Player number one wins further for having covered "H" position 54. Finally, player four, having covered the nine of clubs with a green chip, also wins at predetermined odds. The house, however, recovers the blue chip played by player number one on Joker 12, all of the chips in array 16 except the the red chip at position 34, all of the chips in array 44 except the blue chip in position 48, the chip in "L" position 56, and all of the chips in array 58 except the green chip on the nine of clubs. Player one played only eight chips and won on two of them. Player two played thirteen chips to cover all of the possibilities in array 16, and of course had only one win to balance fifteen losses. Player three played sixteen chips, apparently hoping for a low card to be selected, and lost all of the chips. Player four played twenty one chips, all in array 58, and of course hit on only one card.

From this round of play, player number one learns that a conservative, balanced approach seems to work best. Player number two learns not to place all of his or her eggs in one basket, so to speak. Player number three learns that over-exposure in array 58 is to be avoided, and player number four learns substantially the same lesson. A second round of play will probably produce less chips placed in array 58 and more chips in the other positions. Subsequent rounds of play are likely to produce fewer bets in array 16, and more bets in array 44 and the "H" and "L" positions. Thus, the players gradually learn how odds work and whether it is wise to place large numbers of chips at risk.

The novel game can be played with an extra deck if desired, an extra Joker, and so on. In a preferred embodiment, the odds placed on Joker positions 12 and 14 are 25 to 1. The odds on the positions of array 58 are even, and the odds on the other two arrays 16 and 44 as well as the odds on "H" and "L" positions 54, 56, are somewhere between those extremes.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method of playing a card game, comprising the steps of:

providing a first plurality of indicia means representing all of the face values of cards in a deck of cards without specifying any suit;

providing a second plurality of indicia means representing the four suits in a deck of cards without specifying any face value;

providing a third plurality of indicia means representing all individual cards in a deck of cards wherein each indicia means specifies a card by its face value and its suit;

providing said first, second and third plurality of indicia means in a form such that said first, second and third indicia means are independent and separate from one another, said first indicia means including thirteen independent indicia means located in areas remote from said second and third indicia means, said second indicia including four independent indicia means located in areas remote from said first and third indicia means and said third indicia means including fifty two independent indicia means located in areas remote from said first and second indicia means;

at least one player positioning at least one marker on at least one indicia means of said first, second and third plurality of indicia means;

randomly shuffling a deck of cards;

randomly selecting a single card from said deck of cards;

said at least one player winning said game only if said at least one marker is positioned on an indicia means representing said single card;

whereby at least one marker positioned on at least one of said indicia means of said first indicia means results in a win by the at least one player positioning said marker thereon if said marker matches said randomly selected single card;

whereby at least one marker positioned on at least one of said indicia means of said second indicia means results in a win by the at least one player positioning said marker thereon if said marker matches said randomly selected single card;

whereby at least one marker positioned on at least one of said indicia means of said third indicia means results in a win by the at least one player positioning said marker thereon if said marker matches said randomly selected single card; and whereby each indicia means of said first, second and third indicia means represents only one face value, suit or card so that placing a marker on a selected indicia means represents an unambiguous bet.

2. The method of claim 1, further comprising the steps of:

providing a fourth indicia means representing all of the face values of cards in a deck of cards that are equal to or below a preselected face value;

providing a fifth indicia means representing all of the face values of cards in a deck of cards that are above said preselected value;

providing said fourth and fifth plurality of indicia means in a form such that said fourth and fifth indicia means are independent from one another, said fourth indicia means including one independent indicia means and said fifth indicia means including one independent indicia means;

whereby a marker positioned on said fourth indicia means results in a win by the player positioning said marker thereon if said marker matches said randomly selected single card;

whereby a marker positioned on said fifth indicia means results in a win by the player positioning said marker thereon if said marker matches said randomly selected single card; and whereby placing a marker on a selected indicia means represents an unambiguous bet.

3. The method of claim 2, further comprising the step of:

providing a sixth indicia means representing at least one Joker card;

providing said sixth indicia means in a form such that said sixth indicia means is independent from said first, second, third, fourth and fifth indicia means;

whereby a marker positioned on said sixth indicia means results in a win by the player positioning said marker thereon if said marker matches said randomly selected single card; and whereby placing a marker on a selected indicia means represents an unambiguous bet.

* * * * *